US008322418B2

(12) United States Patent
Martinez et al.

(10) Patent No.: US 8,322,418 B2
(45) Date of Patent: Dec. 4, 2012

(54) OFFSET INTERIOR SLURRY DISCHARGE

(75) Inventors: Samuel Martinez, Cedar Hill, TX (US); Emile E. Sevadjian, Carrollton, TX (US); Phillip T. Thomas, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 219 days.

(21) Appl. No.: 12/632,884

(22) Filed: Dec. 8, 2009

(65) Prior Publication Data

US 2011/0132603 A1 Jun. 9, 2011

(51) Int. Cl.
*E21B 43/04* (2006.01)

(52) U.S. Cl. ..... 166/275; 166/222

(58) Field of Classification Search ..... 166/275, 166/222, 278, 51, 382, 386, 91.1, 169
See application file for complete search history.

(56) References Cited

U.S. PATENT DOCUMENTS 4,566,538 A 1/1986 Peterson
5,636,691 A 6/1997 Hendrickson et al.
6,491,097 B1 12/2002 Oneal et al.
7,503,384 B2 * 3/2009 Coronado ..... 166/51
2006/0191685 A1 8/2006 Coronado
2008/0314589 A1 12/2008 Guignard et al.

OTHER PUBLICATIONS

Search Report issued May 27, 2011 for International Patent Application Serial No. PCT/US10/57538, 5 pages.
Written Opinion issued May 27, 2011 for International Patent Application Serial No. PCT/US10/57538, 3 pages.
FracPac™ Systems Halliburton Product Brochure H05818, Dec. 2007, 4 pages.

* cited by examiner

*Primary Examiner* — Daniel P Stephenson
(74) *Attorney, Agent, or Firm* — Smith IP Services, P.C.

(57) ABSTRACT

A slurry discharge device for use in a subterranean well can include a slurry flow passage extending longitudinally in the device. The slurry flow passage has flow passage sections. One flow passage section is positioned downstream of, and is laterally offset relative to, another flow passage section. Another slurry discharge device can include the slurry flow passage having multiple flow areas. One flow area is positioned in a downstream direction from, and is greater than, another flow area. A method of delivering a slurry into a subterranean well can include discharging the slurry from a tubular string through a first sidewall section of a slurry discharge device; and flowing only a returned fluid portion of the slurry through a second sidewall section of the slurry discharge device. The second sidewall section has a lateral thickness greater than a lateral thickness of the first sidewall section.

21 Claims, 6 Drawing Sheets

OFFSET INTERIOR SLURRY DISCHARGE

BACKGROUND

This disclosure relates generally to equipment utilized and operations performed in conjunction with a subterranean well and, in an example described below, more particularly provides a slurry discharge device and associated methods.

It is common practice to discharge a slurry into a well. For example, in gravel packing operations, the slurry can be a mixture of gravel and a fluid, with the gravel accumulating about a screen in the well to thereby inhibit production of sand and fines from a formation intersected by the well. In fracturing operations, the slurry can be a mixture of proppant and a fluid, with the proppant being used to prop open fractures formed in a formation intersected by the well.

The flow rates and volumes of slurry delivered into wells in such operations have increased in recent years. Unfortunately, these increased slurry flow rates and volumes tend to cause rapid erosion of the equipment used to deliver the slurry into the wells.

Attempts have been made to prevent or mitigate such erosion, but the results of these attempts have not been entirely satisfactory. Therefore, it will be appreciated that improvements are needed in the art of slurry discharge into subterranean wells.

SUMMARY

In the disclosure below, a slurry discharge device and associated methods are provided which bring improvements to the art of slurry delivery in subterranean wells. One example is described below in which one section of a slurry flow passage is laterally offset relative to another section. Another example is described below in which slurry discharge ports of the device are positioned opposite a fluid return flow passage.

In one aspect, a slurry discharge device for use in a subterranean well is provided to the art by the present disclosure. The device can include a slurry flow passage extending longitudinally in the device. The slurry flow passage has first and second flow passage sections. The second flow passage section is positioned downstream of, and is laterally offset relative to, the first flow passage section.

In another aspect, a slurry discharge device is provided which can include a slurry flow passage extending longitudinally in the device, with the slurry flow passage having first and second flow areas. The second flow area is positioned in a downstream direction from the first flow area. The second flow area is greater than the first flow area.

In yet another aspect, a method of delivering a slurry into a subterranean well can include the steps of: discharging the slurry from a tubular string through a first sidewall section of a slurry discharge device; and flowing only a returned fluid portion of the slurry through a second sidewall section of the slurry discharge device. The second sidewall section has a lateral thickness greater than a lateral thickness of the first sidewall section.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
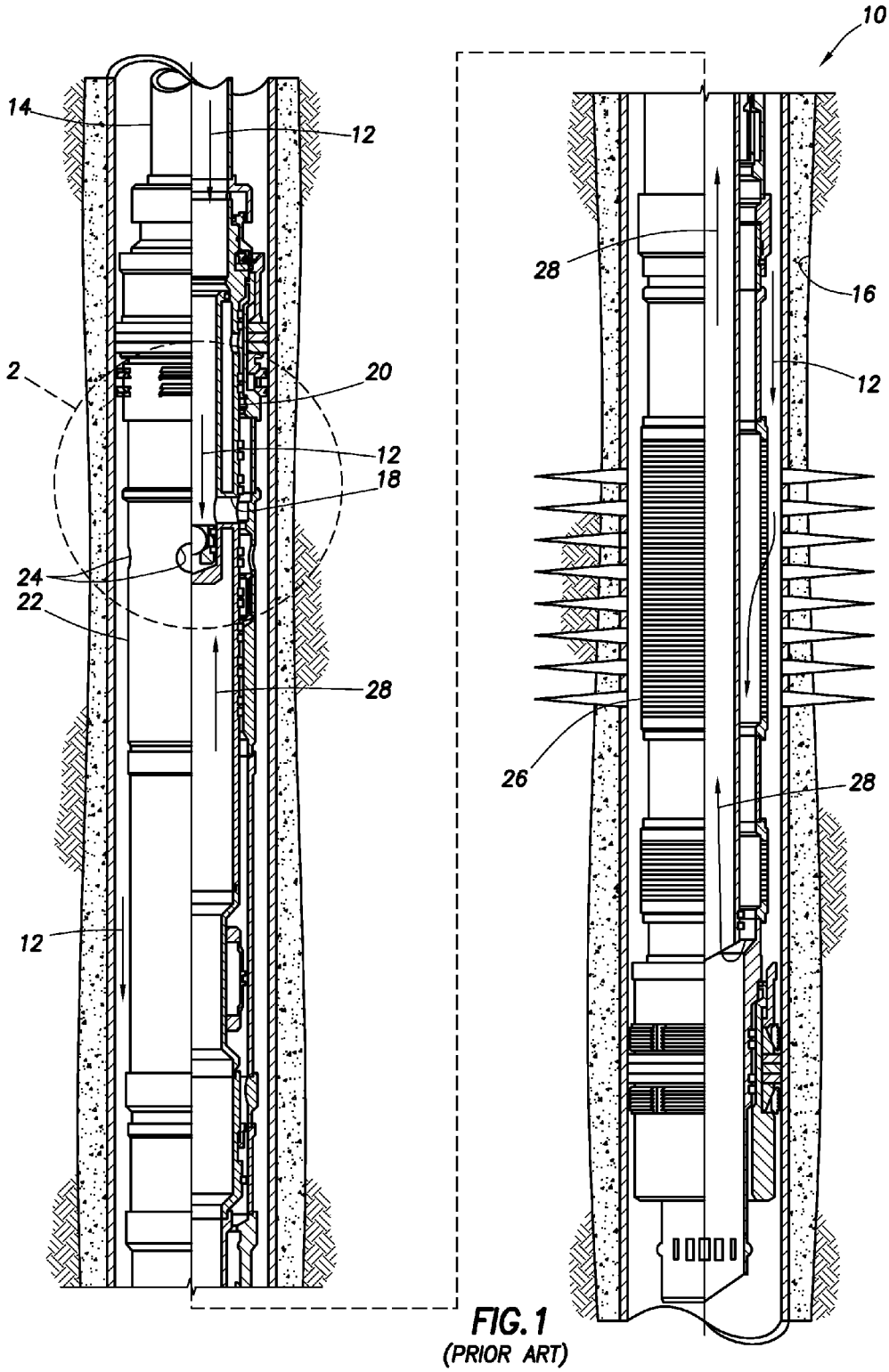
FIG. 1 (PRIOR ART)
FIG. 1 is a schematic partially cross-sectional view of a prior art fracturing/gravel packing system.

Schematically illustrated in FIG. 1 is a prior art slurry delivery system 10. The system 10 may be used for performing a fracturing operation and/or a gravel packing operation, or any other type of operation in which a slurry is delivered into a well.

As shown in FIG. 1, a slurry 12 is flowed through a tubular string 14 positioned in a wellbore 16. As used herein, the term "slurry" is used to indicate a mixture including a particulate matter and a carrier fluid. The particulate matter could comprise, for example, a proppant, sand, gravel, or any other type of particulate matter. The fluid could comprise, for example, water, brine, stimulation fluid, or any other type of fluid.

The slurry 12 is flowed out of the tubular string 14 via discharge ports 18 in a slurry discharge device 20 interconnected in the tubular string. After exiting the tubular string 14, the slurry 12 flows through an annular space between the tubular string and an upper extension 22, and then exits the upper extension via ports 24.

In the system 10 of FIG. 1, the slurry 12 then flows to the exterior of a well screen 26, where a fluid portion 28 of the slurry is allowed to pass inwardly through the screen and into a lower end of the tubular string 14 (e.g., for return to the surface). The particulate matter or gravel accumulates in the annular space surrounding the well screen 26.

Figure 2:
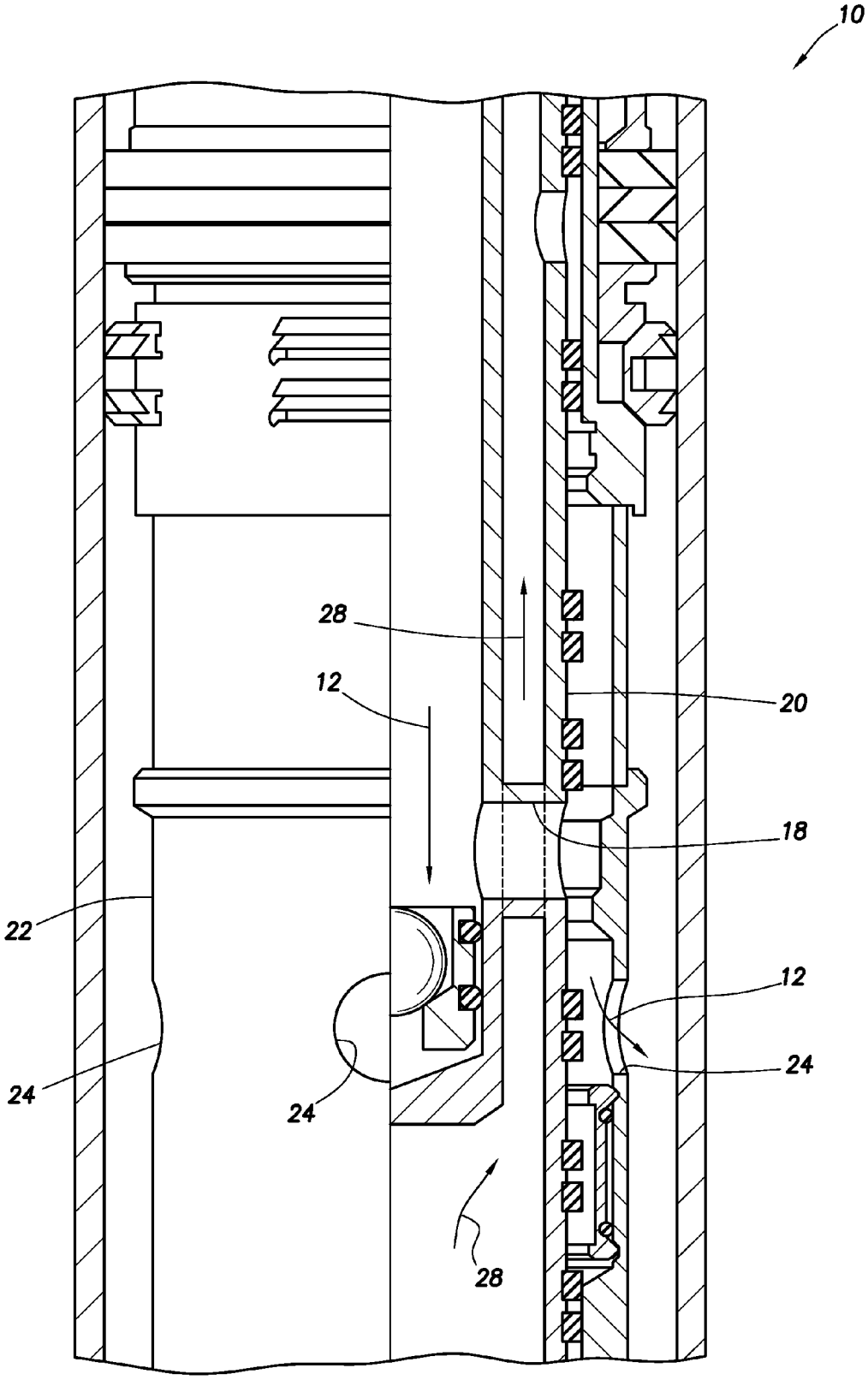
FIG.2 (PRIOR ART)
FIG. 2 is an enlarged scale schematic partially cross-sectional view of a prior art slurry discharge section in the system of FIG. 1.

An enlarged scale view of the slurry discharge device 20 in the system 10 is schematically illustrated in FIG. 2. In this view it may be more clearly seen that multiple flow passages are provided in the discharge device 20 for flow of the slurry 12 and the returned fluid portion 28. Due to the fact that the discharge device 20 is constructed to allow for both lateral discharge flow of the slurry 12 through the ports 18, and longitudinal flow of the slurry and fluid portion 28 in different directions, the discharge device is of the type commonly referred to by those skilled in the art as a "crossover."

Note that, at high flow rates and large volume flow of the slurry 12, relatively rapid erosion of the discharge device 20 in the area surrounding the ports 18 can occur. In some cases, this erosion can lead to fluid communication being permitted between the passages through which the slurry 12 and returned fluid portion 28 flow, in which cases the slurry delivery operation must be stopped, and the tubular string 14 must be retrieved from the well for replacement of the discharge device 20, removal of particulate matter from within the well screen 26, etc. This is very expensive, difficult, inconvenient and time-consuming.

Although the system 10 described above may be used in a fracturing and/or gravel packing operation, with particulate matter accumulating about a well screen 26, and with use of a crossover type of slurry discharge device 20, it should be clearly understood that the principles of this disclosure are not limited in any manner to these or any other details of the system 10. Instead, the principles of this disclosure can be practiced with other types of slurry delivery operations, using other types of slurry delivery systems, without use of a cross-over type slurry discharge device, etc. The system 10 is merely one example of a wide variety of systems into which the principles of this disclosure can be beneficially incorporated.

Figure 3:
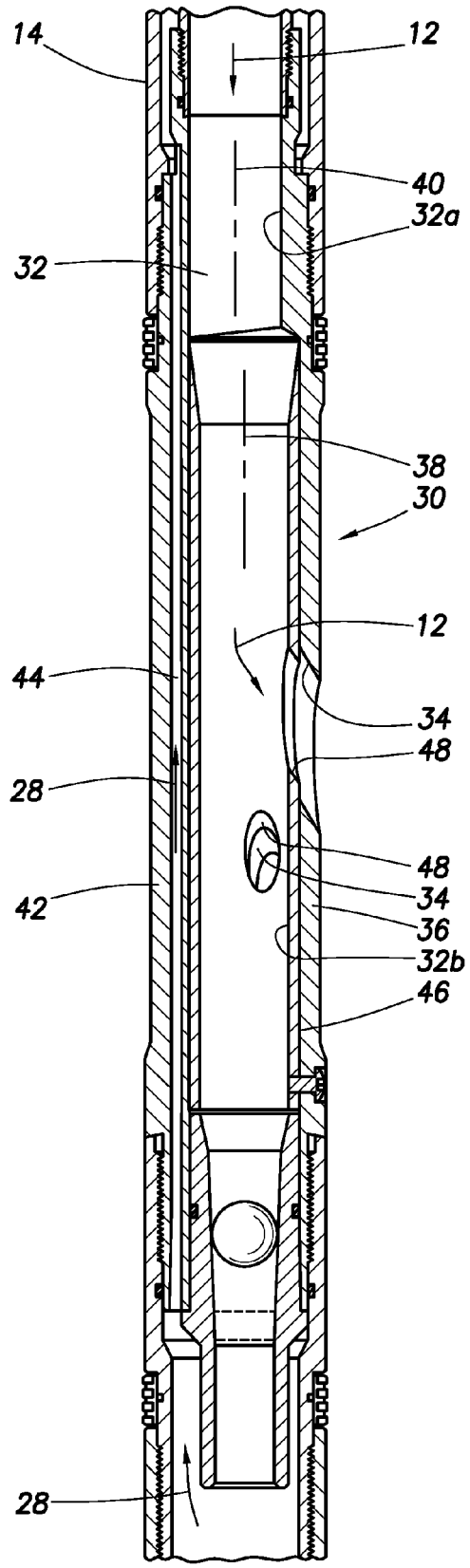
FIG. 3 is a schematic cross-sectional view of a slurry discharge device which embodies principles of the present disclosure.

Referring additionally now to FIG. 3, a slurry discharge device 30 which embodies the principles of the present disclosure is representatively illustrated. The device 30 of FIG. 3 may be substituted for the device 20 in the system 10, but it should be understood that the device 30 can be used in other slurry delivery systems in keeping with the principles of this disclosure.

As depicted in FIG. 3, the slurry 12 is flowed through a slurry flow passage 32 which is in fluid communication with slurry discharge ports 34 formed through a sidewall section 36 of the device 30. The flow passage 32 includes two longitudinal sections 32*a*, 32*b*. The downstream section 32*b* is in fluid communication with the ports 34, and is laterally offset with respect to the upstream section 32*a*.

In this example, a longitudinal axis 38 of the downstream section 32*b* is laterally offset with respect to a longitudinal axis 40 of the upstream section 32*a*. This lateral offsetting of the downstream section 32*b* results in the sidewall section 36 being somewhat thinner as compared to an opposite sidewall section 42.

A fluid return flow passage 44 is formed through the sidewall section 42 for flowing the fluid portion 28 longitudinally through the device 30. Note that this positions the flow passage 44 opposite the ports 34, thereby making it very unlikely that erosion of the ports will lead to fluid communication being permitted between the flow passages 32, 44.

The device 30 also includes a protective sleeve 46 positioned therein. The sleeve 46 is preferably made of a very erosion resistant material (such as carbide, etc.), so that it can protect the sidewall sections 36, 42 from erosion.

However, use of the sleeve 46 is not necessary in keeping with the principles of this disclosure. Note that, if the sleeve 46 is not used, the downstream flow passage section 32*b* in this example would have a larger flow area as compared to that of the upstream flow passage section 32*a*, which would cause the velocity of the slurry 12 to decrease as it enters the downstream section, and this would function to reduce erosion of the sidewall sections 36, 42.

The sleeve 46 as depicted in FIG. 3 has openings 48 formed therethrough which are aligned with respective ones of the ports 34. In the illustrated example, each one of the openings 48 is aligned with a respective one of the ports 34, but in other examples multiple openings could be aligned with a single port.

The ports 34 and openings 48 are angled longitudinally downward as depicted in FIG. 3. In addition, the ports 34 and openings 48 are distributed helically (both circumferentially and longitudinally) in the device 30. These features are used to induce a helically directed swirling flow of the slurry 12 as it is discharged from the device 30, in order to mitigate erosion of the surrounding upper extension 22.

Figure 4:
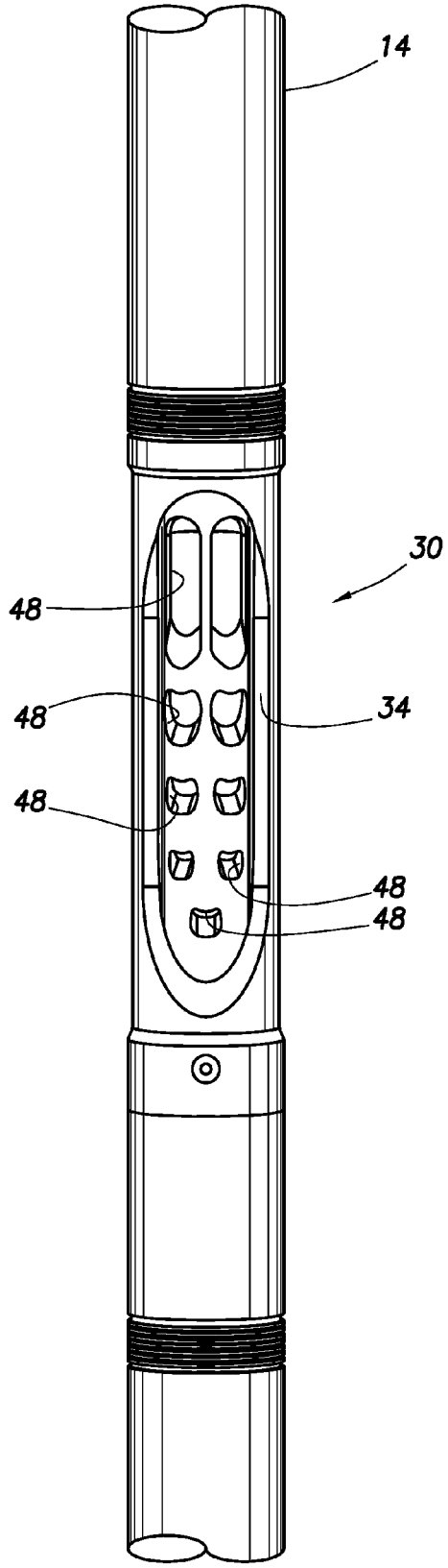
FIG. 4 is a schematic elevational view of another configuration of the slurry discharge device.
Figure 5:
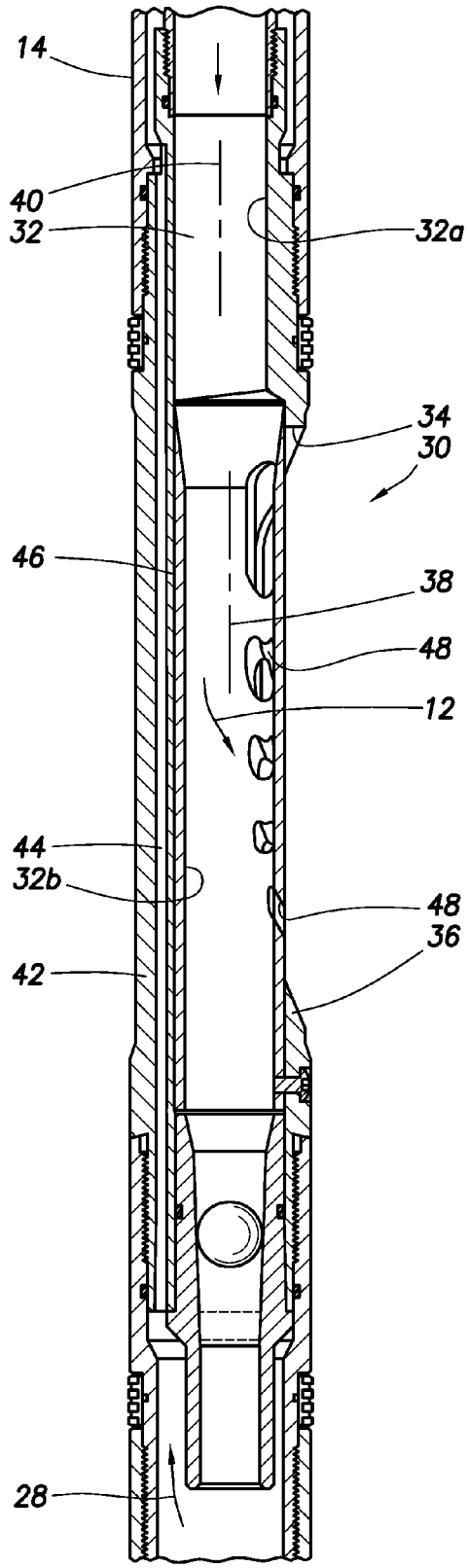
FIG. 5 is a schematic cross-sectional view of the slurry discharge device of FIG. 4.

Referring additionally now to FIGS. 4 & 5, another configuration of the slurry discharge device 30 is representatively illustrated. In this configuration, multiple openings 48 in the protective sleeve 46 are in fluid communication with one slurry discharge port 34.

Note that the downstream flow passage section 32*b* is laterally offset with respect to the upstream flow passage section 32*a*, and the sidewall section 36 is laterally thinner than the opposite sidewall section 42. The fluid return flow passage 44 is formed longitudinally through the laterally thicker sidewall section 42.

Figure 6:
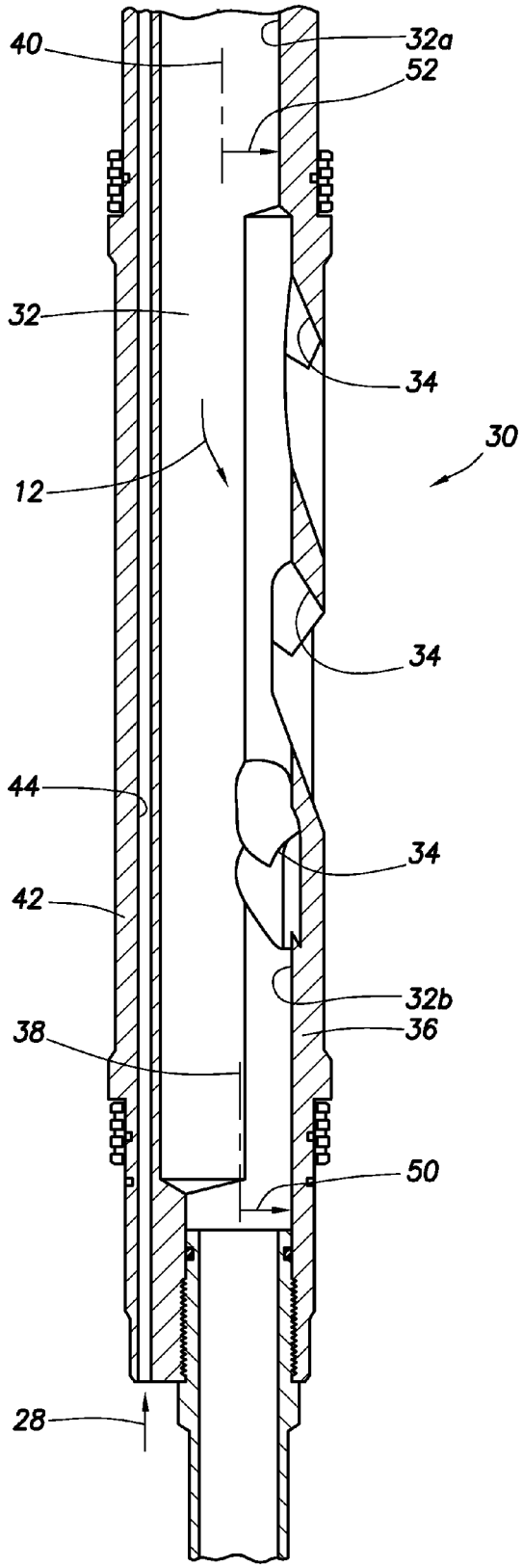
FIG. 6 is a schematic cross-sectional view of another configuration of the slurry discharge device.

Referring additionally now to FIG. 6, yet another configuration of the slurry discharge device 30 is representatively illustrated. In this example, the protective sleeve 46 is not used, but it should be understood that a protective sleeve could be used in the configuration of FIG. 6 in keeping with the principles of this disclosure. For example, the protective sleeve 46 depicted in FIGS. 3-5 could be installed in the flow passage section 32*b* depicted in FIG. 6 (in which case the flow passage section 32*b* could extend through the protective sleeve 46).

Note that a flow area of the downstream flow passage section 32*b* as depicted in FIG. 6 is greater than a flow area of the upstream flow passage section 32*a*. This is due to an inner radius 50 of the downstream flow passage section 32*b* being laterally offset relative to an inner radius 52 of the upstream flow passage section 32*a*. The inner radius 52 is also formed in the sidewall section 42 in this example.

In addition, note that the discharge ports 34 are angled both longitudinally downward and radially, so as to induce a helical swirling flow of the slurry 12 as it exits the ports. The ports 34 are also helically arranged in the sidewall section 36.

It may now be fully appreciated that the above disclosure provides several advancements to the art of slurry delivery in subterranean wells. Some benefits derived from use of the slurry delivery device 30 are reduced erosion of the ports 34, prevention of fluid communication between the passages 32, 44 and reduced erosion of the upper extension 22.

In particular, the above disclosure provides to the art a slurry discharge device 30 for use in a subterranean well. The device 30 can include a slurry flow passage 32 extending longitudinally in the device 30. The slurry flow passage 32 has first and second flow passage sections 32*a*, 32*b*. The second flow passage section 32*b* is positioned downstream of, and laterally offset relative to, the first flow passage section 32*a*.

A first sidewall section 36 of the slurry discharge device 30 may be positioned opposite the second flow passage section 32*b* from a second sidewall section 42 of the slurry discharge device 30. The second sidewall section 42 may have a lateral thickness greater than a lateral thickness of the first sidewall section 36.

An inner radius 50 of the first sidewall section 36 may be laterally offset relative to an inner radius 52 of the second sidewall section 42.

The first and second flow passage sections 32*a*, 32*b* may have respective first and second flow areas. The second flow area may be greater than the first flow area.

At least one slurry discharge port 34 may be in fluid communication with the second flow passage section 32*b*. The slurry discharge port 34 may be angled radially, whereby a slurry 12 discharged from the slurry discharge port 34 may be caused to flow circumferentially about an exterior of the slurry discharge device 30. The slurry discharge port 34 may also be angled longitudinally, whereby the slurry 12 discharged from the slurry discharge port 34 may be caused to flow helically about the exterior of the slurry discharge device 30.

The slurry discharge port 34 may extend through a first sidewall section 36 of the device 30. The first sidewall section 36 may be thinner than a second sidewall section 42 of the device 30 positioned opposite the second flow passage section 32*b* from the first sidewall section 36. A fluid return flow passage 44 may extend longitudinally through the second sidewall section 42.

A protective sleeve 46 may be in the second flow passage section 32*b*. Multiple openings 48 formed through a sidewall of the protective sleeve 46 may be in fluid communication with the slurry discharge port 34.

Also described above is a slurry discharge device 30 for use in a subterranean well which can include a slurry flow passage 32 extending longitudinally in the device 30, with the slurry flow passage 32 having first and second flow areas. The second flow area is positioned in a downstream direction from the first flow area, and the second flow area is greater than the first flow area.

At least one slurry discharge port 34 may be in fluid communication with the second flow area.

The slurry discharge port 34 may extend through a first sidewall section 36 of the device 30. The first sidewall section 36 may be thinner than a second sidewall section 42 of the device 30 positioned opposite the first sidewall section 36.

An inner radius 50 of the first sidewall section 36 may be laterally offset relative to an inner radius 52 of the second sidewall section 42. A fluid return flow passage 44 may extend longitudinally through the second sidewall section 42.

The slurry flow passage 32 may extend through a protective sleeve 46. Multiple openings 48 formed through a sidewall of the protective sleeve 46 may be in fluid communication with the slurry discharge port 34.

The above disclosure also provides a method of delivering a slurry 12 into a subterranean well. The method can include the steps of: discharging the slurry 12 from a tubular string 14 through a first sidewall section 36 of a slurry discharge device 30; and flowing only a returned fluid portion 28 of the slurry 12 through a second sidewall section 42 of the slurry discharge device 30. The second sidewall section 42 has a lateral thickness greater than a lateral thickness of the first sidewall section 36.

The second sidewall section 42 may be positioned laterally opposite the first sidewall section 36.

The discharging step may include flowing the slurry 12 through a slurry flow passage 32 from a first flow area to a second flow area, with the second flow area being greater than the first flow area.

The discharging step may include flowing the slurry 12 through a slurry flow passage 32 from a first flow area to a second flow area, with the second flow area being laterally offset relative to the first flow area.

The discharging step may include flowing the slurry 12 through a slurry flow passage 32 from a first flow passage section 32*a* to a second flow passage section 32*b*. The second flow passage section 32*b* may be laterally offset relative to the first flow passage section 32*a*.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A slurry discharge device for use in a subterranean well, the device comprising:

a slurry flow passage extending longitudinally in the device, the slurry flow passage having first and second flow passage sections, a first longitudinal axis of the first flow passage section being parallel to and laterally offset from a second longitudinal axis of the second flow passage section, and the second flow passage section being positioned downstream of the first flow passage section; and a protective sleeve which lines the second flow passage section.

2. The slurry discharge device of claim 1, wherein a first sidewall section of the slurry discharge device is positioned opposite the second flow passage section from a second sidewall section of the slurry discharge device, the second sidewall section having a lateral thickness greater than a lateral thickness of the first sidewall section.

3. The slurry discharge device of claim 2, wherein an inner radius of the first sidewall section is laterally offset relative to an inner radius of the second sidewall section.

4. The slurry discharge device of claim 1, wherein the first and second flow passage sections have respective first and second flow areas, the second flow area being greater than the first flow area.

5. The slurry discharge device of claim 1, wherein at least one slurry discharge port is in fluid communication with the second flow passage section.

6. The slurry discharge device of claim 5, wherein the slurry discharge port is angled radially, whereby a slurry discharged from the slurry discharge port is caused to flow circumferentially about an exterior of the slurry discharge device.

7. The slurry discharge device of claim 6, wherein the slurry discharge port is also angled longitudinally, whereby the slurry discharged from the slurry discharge port is induced to flow helically about the exterior of the slurry discharge device.

8. The slurry discharge device of claim 5, wherein the slurry discharge port extends through a first sidewall section of the device, and wherein the first sidewall section is thinner than a second sidewall section of the device positioned opposite the second flow passage section from the first sidewall section.

9. The slurry discharge device of claim 8, wherein a fluid return flow passage extends longitudinally through the second sidewall section.

10. The slurry discharge device of claim 8, wherein multiple openings formed through a sidewall of the protective sleeve are in fluid communication with the slurry discharge port.

11. A slurry discharge device for use in a subterranean well, the device comprising:

a slurry flow passage extending longitudinally in the device, the slurry flow passage having first and second flow areas, the second flow area being positioned in a downstream direction from the first flow area, and the second flow area being greater than the first flow area; and a protective sleeve which lines the second flow area.

12. The slurry discharge device of claim 11, wherein at least one slurry discharge port is in fluid communication with the second flow area.

13. The slurry discharge device of claim 12, wherein the slurry discharge port extends through a first sidewall section of the device, and wherein the first sidewall section is thinner than a second sidewall section of the device positioned opposite the first sidewall section.

14. The slurry discharge device of claim 13, wherein an inner radius of the first sidewall section is laterally offset relative to an inner radius of the second sidewall section.

15. The slurry discharge device of claim 13, wherein a fluid return flow passage extends longitudinally through the second sidewall section.

16. The slurry discharge device of claim 12, wherein the slurry flow passage extends through the protective sleeve, and wherein multiple openings formed through a sidewall of the protective sleeve are in fluid communication with the slurry discharge port.

17. A method of delivering a slurry into a subterranean well, the method comprising the steps of:

discharging the slurry from a tubular string through a first sidewall section of a slurry discharge device; and flowing only a returned fluid portion of the slurry through a second sidewall section of the slurry discharge device, the second sidewall section having a lateral thickness greater than a lateral thickness of the first sidewall section, and the first and second sidewall sections being internally lined with a protective sleeve.

18. The method of claim 17, wherein the second sidewall section is positioned laterally opposite the first sidewall section.

19. The method of claim 17, wherein the discharging step further comprises flowing the slurry through a slurry flow passage from a first flow area to a second flow area, the second flow area being greater than the first flow area.

20. The method of claim 17, wherein the discharging step further comprises flowing the slurry through a slurry flow passage from a first flow area to a second flow area, and wherein the second flow area is laterally offset relative to the first flow area.

21. The method of claim 17, wherein the discharging step further comprises flowing the slurry through a slurry flow passage from a first flow passage section to a second flow passage section, and wherein the second flow passage section is laterally offset relative to the first flow passage section.

* * * * *